US011367586B2

(12) United States Patent
Schautzgy et al.

(10) Patent No.: US 11,367,586 B2
(45) Date of Patent: Jun. 21, 2022

(54) OVERCURRENT PROTECTION DEVICE

(71) Applicant: ETO MAGNETIC GmbH, Stockach (DE)

(72) Inventors: Maximilian Schautzgy, Meersburg (DE); Thomas Schiepp, Seitingen-Oberflacht (DE); Markus Laufenberg, Stockach (DE)

(73) Assignee: ETO MAGNETIC GmbH, Hardtring (DE)

( * ) Notice: Subject to any disclaimer, the term of this patent is extended or adjusted under 35 U.S.C. 154(b) by 293 days.

(21) Appl. No.: 16/495,643

(22) PCT Filed: Mar. 21, 2018

(86) PCT No.: PCT/EP2018/057186
§ 371 (c)(1),
(2) Date: Sep. 19, 2019

(87) PCT Pub. No.: WO2018/172418
PCT Pub. Date: Sep. 27, 2018

(65) Prior Publication Data

US 2020/0111633 A1 Apr. 9, 2020

(30) Foreign Application Priority Data

Mar. 21, 2017 (DE) ..... 10 2017 106 084.7

(51) Int. Cl.
*H01H 71/40* (2006.01)
*H01H 73/50* (2006.01)

(52) U.S. Cl.
CPC ..... *H01H 73/50* (2013.01); *H01H 71/40* (2013.01)

(58) Field of Classification Search
CPC ..... H01H 73/50; H01H 73/66; H01H 73/48; H01H 37/323; H01H 71/2454;
(Continued)

(56) References Cited

U.S. PATENT DOCUMENTS 4,205,293 A 5/1980 Melton et al.
5,001,446 A 3/1991 Tsuji et al.
(Continued)

FOREIGN PATENT DOCUMENTS

CN 2463965 Y 12/2001
CN 102899513 A 1/2013
(Continued)

OTHER PUBLICATIONS

Chinese Office Action dated Mar. 31, 2021 issued in corresponding CN patent application No. 201880033419.3 (and English Summary).
(Continued)

*Primary Examiner* — Bryan R Perez
(74) *Attorney, Agent, or Firm* — Posz Law Group, PLC

(57) ABSTRACT

An overcurrent protection device for a circuit to be monitored, includes at least one trigger unit, which is configured for an interruption of the circuit in at least one trigger situation and which comprises at least one conductor section, which is configured for a conduction of a current to be monitored, at least one trigger element, which comprises at least one magnetically and thermally shape-shiftable material and is, in the trigger situation, configured for a thermally-induced and/or magnetically-induced deformation in dependence on a current that flows through the conductor section, and at least one actuation element, which is operatively connected with the trigger element and is configured for a transmission of at least one actuation movement and/or at least one actuation force to at least one interrupter switch.

19 Claims, 4 Drawing Sheets

Figure 1:
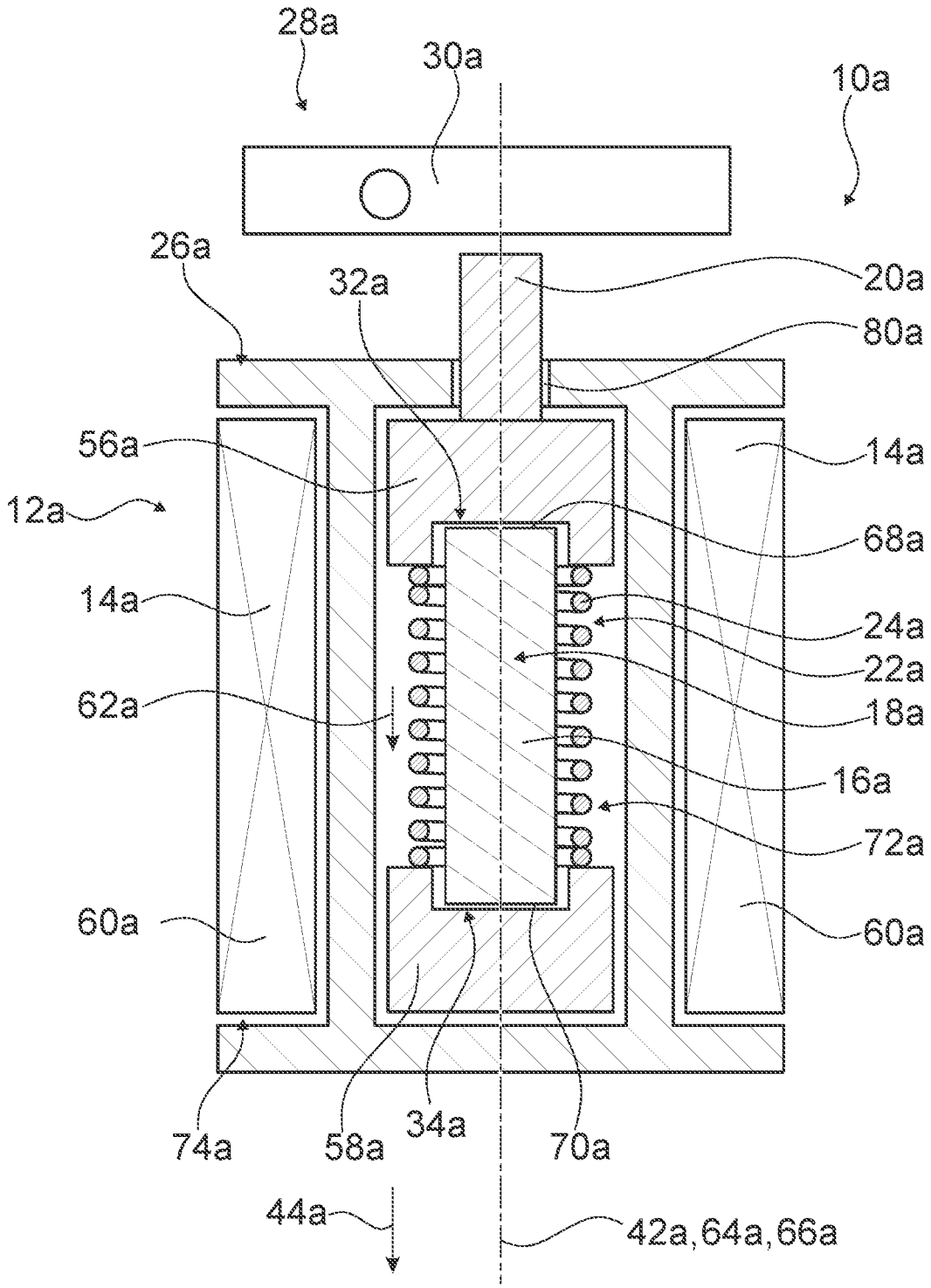

(58) Field of Classification Search
CPC .... H01H 71/40; H01H 71/145; H01H 71/127; H01H 71/407
See application file for complete search history.

(56) References Cited

U.S. PATENT DOCUMENTS

| | | | | |
|---|---|---|---|---|
| 2002/0101220 | A1 | 8/2002 | Yang | |
| 2003/0025477 | A1 | 2/2003 | Yang | |
| 2006/0144048 | A1* | 7/2006 | Schulz | F03G 7/06 60/641.8 |
| 2008/0018422 | A1 | 1/2008 | Claeys et al. | |
| 2008/0258850 | A1* | 10/2008 | Claeys | H01H 71/2454 335/36 |
| 2008/0297005 | A1* | 12/2008 | Sakashita | H01L 41/18 310/330 |
| 2015/0228433 | A1* | 8/2015 | Carrillo Soto | H01H 71/40 335/43 |
| 2016/0365509 | A1* | 12/2016 | Saida | G11C 11/1693 |
| 2017/0076899 | A1 | 3/2017 | Mullner | |

FOREIGN PATENT DOCUMENTS

| | | | |
|---|---|---|---|
| CN | 104946913 | A1 | 9/2015 |
| DE | 27 24 255 | A1 | 11/1978 |
| DE | 689 11 614 | T2 | 5/1994 |
| DE | 10 2004 056 279 | A1 | 5/2006 |
| DE | 102004056280 | A1 | 5/2006 |
| DE | 10 2004 056 281 | A1 | 6/2006 |
| DE | 10 2004 056 283 | A1 | 6/2006 |
| DE | 10 2012 011 063 | A1 | 12/2013 |
| EP | 0 353 816 | B1 | 12/1993 |
| EP | 0980600 | A2 | 2/2000 |
| EP | 2 750 580 | B1 | 9/2015 |
| WO | 99/45631 | A2 | 9/1999 |
| WO | 2006/056335 | A1 | 6/2006 |

OTHER PUBLICATIONS

German Search Report dated Jan. 17, 2018 issued in corresponding DE patent application No. 10 2017 106 084.7 (and partial English translation).

International Search Report dated Jun. 12, 2018 issued in corresponding International Patent Application No. PCT/EP2018/057186.

International Preliminary Report on Patentability dated Sep. 24, 2019 issued in corresponding International Patent Application No. PCT/EP2018/057186.

* cited by examiner

OVERCURRENT PROTECTION DEVICE

CROSS REFERENCE TO RELATED APPLICATIONS

This application is a U.S. national stage application of PCT/EP2018/057186 filed on Mar. 21, 2018, which is based on German Patent Application No. 10 2017 106 084.7 filed on Mar. 21, 2017, the contents of which are incorporated herein by reference.

PRIOR ART

The invention relates to an overcurrent protection device as claimed in claim 1.

Overcurrent protection switches are known from the prior art which comprise an electromagnetic short-circuit current trigger unit and a thermal overcurrent protection trigger unit. Electromagnetic short-circuit current trigger units frequently have a trigger armature operating according to the reluctance principle in this case. Furthermore, overcurrent protection trigger units often comprise bimetal trigger units.

An overcurrent protection switch is known from DE 10 2004 056 283 A1, which comprises a striking anchor and two snapping elements, of which one is formed of a thermostatic bimetal and one is formed of a magnetic shape-memory material. A current to be monitored flows in this case through a coil and generates a magnetic field in a short-circuit situation, which induces a deformation of the snapping element made of the magnetic shape-memory material. An overcurrent protection switch having a trigger coil and a trigger element, which is deformable by means of a trigger coil conducting a current to be monitored and is made of a magnetic shape-memory material, is also known from DE 10 2012 011 063 A1. Furthermore, an overcurrent switch having a trigger element made of a magnetic shape-memory material is known from DE 10 2010 014 280 A1, with which a coil-free conductor section is associated, through which a current to be monitored flows.

The objective of the invention is in particular to provide a generic overcurrent protection device with advantageous properties with respect to a design. Furthermore, one object of the invention is in particular to achieve a high level of reliability. Furthermore, one object of the invention is in particular to reduce a variety of parts. The object is achieved according to the invention by the features of claim 1, while advantageous embodiments and refinements of the invention can be inferred from the dependent claims.

Advantages of the Invention

The invention relates to an overcurrent protection device for a circuit to be monitored, having at least one trigger unit, which is configured for interrupting the circuit in at least one trigger situation, and which has at least one conductor section, which is configured for conducting a current to be monitored, in particular a current that flows in the circuit to be monitored, at least one trigger element, which comprises at least one magnetically and thermally shape-shiftable material and is configured in the trigger situation for a thermally-induced and/or magnetically-induced deformation in dependence on a current that flows through the conductor section, and at least one actuation element, which is operatively connected with the trigger element, and is configured for transmitting at least one actuation movement and/or at least one actuation force to at least one interrupter switch.

Advantageous properties with respect to a structure and/or a construction can be achieved by the implementation according to the invention. A high level of reliability can advantageously be achieved. Moreover, a high degree of flexibility with respect to an adaptation of a triggering behavior can be achieved. Furthermore, a variety of parts can advantageously be reduced. In particular, a common and/or single trigger element can be provided, which replaces two differently designed trigger elements, in particular one short-circuit trigger element and one overload trigger element. A rapid reaction time of a circuit breaker can preferably be achieved. An overcurrent protection device can advantageously be provided, the trigger currents and/or trigger delays and/or trigger times of which are settable in a simple and/or controlled manner, in particular by means of a selection of suitable materials and/or geometries of a trigger element and/or a conductor element and/or magnetizable and/or non-magnetizable components. Moreover, an at least substantially maintenance-free overcurrent protection device can be provided. A compact construction and/or a simple installation can advantageously be enabled.

An "overcurrent protection device" is in particular to mean at least one component, in particular a trigger and/or monitoring component, of an overcurrent protection switch, in particular a line circuit breaker, advantageously a low-voltage line circuit breaker, but also in particular a high-voltage line circuit breaker, for example, of an automatic circuit breaker. In particular, the overcurrent protection device is configured for use in and/or installation in an overcurrent protection switch. The overcurrent protection device and/or the overcurrent protection switch is advantageously configured to protect the circuit and/or its lines from an overload and/or an overcurrent and/or a short-circuit current. "Configured" is in particular to mean specifically programmed, designed, and/or equipped. An object being configured for a specific function is in particular to mean that the object fulfills and/or executes this specific function in at least one application and/or operation state.

In particular, the trigger situation comprises an overcurrent situation, in particular a short-circuit situation and/or overload situation. In particular, the trigger situation, in particular in an overload situation, can comprise a thermal trigger situation. Furthermore, the trigger situation, in particular in a short-circuit situation, can comprise a magnetic trigger situation. The trigger element is preferably configured both for the thermally-induced deformation, in particular in an overload situation, and also for the magnetically-induced deformation, in particular in a short-circuit situation. The thermally-induced deformation and/or magnetically-induced deformation particularly preferably comprises at least one length change of the trigger element, in particular along its longitudinal axis. The trigger element is advantageously configured for a generation of the actuation movement and/or the actuation force, in particular directly as a result of the thermally-induced deformation and/or the magnetically-induced deformation. The actuation movement is advantageously a lift and/or a longitudinal extension change of the trigger element. It is also conceivable that the trigger element is configured for the purpose of generating the actuation force and/or the actuation movement as a result of a deformation in a direction at an angle and/or perpendicularly to the longitudinal axis of the trigger element. In particular, the current in the trigger situation is greater than a limiting current, in particular a normal household limiting current. The trigger unit can be designed in this case for arbitrary limiting currents, for example for limiting currents between 1 A and 100 A, but also for significantly larger or significantly smaller limiting currents in particular. A person skilled in the art will reasonably select a corresponding limiting current in this case. For example, a trigger characteristic can be adapted according to DIN EN 60898-1 (VDE 0641-11). Furthermore, the current in the overload situation is in particular less than in the short-circuit situation. In particular, the current in the overload situation is greater than the limiting current and less than an overload limiting current, wherein the overload limiting current can be, for example, 100 A or 200 A or 300 A or 400 A or an arbitrary current in particular located therebetween. Furthermore, the current in the short-circuit current is in particular greater than the overload limiting current, for example, greater than 300 A or 400 A or 475 A or 500 A, wherein also currents located therebetween or in particular significantly greater currents are also conceivable. In particular in the thermal trigger situation, an overcurrent is present over a longer timeframe than in the magnetic trigger situation, before the trigger element actuates the interrupter switch.

In an assembled state, the conductor section advantageously forms a part of the circuit to be monitored or forms a circuit jointly with the circuit to be monitored. The conductor section preferably comprises a coil or is part of a coil. However, it is also conceivable that the conductor section is formed as a conductor which in particular extends linearly or in a curve, but is preferably not wound or wound multiple times, in particular a single conductor. The conductor section preferably heats up in the trigger situation, in particular in the thermal trigger situation, in particular as a result of a current exceeding the limiting current in the circuit to be monitored. The current that flows in the conductor section particularly preferably generates a trigger magnetic field for the trigger element in the circuit to be monitored in the trigger situation, in particular in the short-circuit situation. The trigger element is preferably arranged at least in a majority in a near region of the conductor section. In particular, the trigger element can be influenced and/or deformed by means of the conductor section and/or by means of a magnetic field generated by means of the conductor section, in particular in the trigger situation. A "near region" is to be understood in particular as a spatial region which is formed from points which are preferably at a distance of less than one-third, preferably less than one-fourth, preferably less than one-sixth, and particularly preferably less than one-tenth of a minimal longitudinal extension of the trigger element from a reference point and/or a reference component, in particular the trigger element, and/or which each have a spacing of at most 10 mm, preferably of at most 5 mm, and particularly preferably of at most 3 mm from a reference point and/or a reference component, in particular the trigger element. The expression "at least in a majority" is to be understood in this case in particular as at least 55%, advantageously at least 65%, preferably at least 75%, particularly preferably at least 85%, and particularly advantageously at least 95%, but in particular also completely.

In particular, the interrupting switch is part of the overcurrent protection switch and in particular is not a part of the overcurrent protection device. The overcurrent protection switch preferably comprises a circuit breaker housing in which the overcurrent protection device is arranged. However, it is also conceivable that the overcurrent protection device comprises the interrupting switch and/or the circuit breaker housing. The overcurrent protection switch and/or the overcurrent protection device preferably comprises at least one arc chamber for a resulting arc. Furthermore, it is conceivable that the trigger element and/or the actuation element and/or the conductor section forms at least a part of the overcurrent protection switch. For example, the overcurrent protection switch can be a trigger mechanism, in particular a trigger mechanism of an automatic circuit breaker. The actuation element preferably comprises at least one actuation surface, which is configured for a transmission of the actuation movement and/or the actuation force. The actuation surface is particularly preferably arranged at least in sections at least substantially perpendicularly to a main deformation axis and/or at least substantially perpendicularly to a longitudinal axis of the trigger element. The actuation element advantageously comprises at least one tappet and/or is formed as such. The actuation element is particularly advantageously formed oblong and/or rod-shaped and/or pin-shaped and/or cylindrical. In particular, the main deformation axis is the axis of greatest deformation of the trigger element. The main deformation direction is preferably arranged at least substantially in parallel to the longitudinal axis of the trigger element. The longitudinal axis is advantageously arranged at least substantially in parallel to a main extension direction of the trigger element. "At least substantially perpendicularly" is to be understood here in particular as an alignment of a direction in relation to a reference direction, in particular in a reference plane, wherein the direction and the reference direction include an angle which deviates in particular less than 8°, advantageously less than 5°, and particularly advantageously less than 2° from a right angle. "At least substantially in parallel" is to be understood here in particular as an alignment of a direction in relation to a reference direction, in particular in a plane, wherein the direction has a deviation in relation to the reference direction in particular less than 8°, advantageously less than 5°, and particularly advantageously less than 2°. A "main extension direction" of an object is to be understood in this case in particular as a direction which extends in parallel to a longest edge of a smallest imaginary cuboid which still just completely encloses the object.

The trigger element is preferably formed oblong. The trigger element is particularly preferably formed cuboid or rod-shaped or pin-shaped or cylindrical. The trigger element preferably has an at least substantially constant cross section. The trigger element is preferably formed in one piece. The trigger element is advantageously formed as a solid body. However, it is also conceivable that the trigger element is formed, in particular at least in sections, as a hollow body, for example as a hollow cylinder, and/or as a solid body having recesses and/or cavities or the like. The trigger element is preferably formed at least in a majority, in particular completely, from the shape-shiftable material. The overcurrent protection device particularly preferably comprises a single trigger element. However, it is also conceivable that the overcurrent protection device comprises multiple trigger elements, which are in particular formed identically or differently in relation to one another. An object having an "at least substantially constant cross section" is to be understood to mean in particular in this case that for an arbitrary first cross section of the object along at least one direction and an arbitrary second cross section of the object along the direction, a minimal surface area of a differential area which is formed upon superposition of the cross sections is at most 20%, advantageously at most 10%, and particularly advantageously at most 5% of the surface area of the larger of the two cross sections.

The shape-shiftable material is preferably a thermally and magnetically shape-shiftable material, in particular a thermal and magnetic shape-memory material. The trigger element is preferably formed as thermally and magnetically shape-changing. It is conceivable that the shape-shiftable material is a magnetostrictive material. The shape-shiftable material is advantageously a magnetically and/or thermally effective and/or active shape-memory material, however, in particular a magnetic and/or thermal shape-memory material, and particularly preferably a magnetic shape-memory alloy (also known as MSM material=magnetic shape memory). The shape-shiftable material preferably comprises at least one, in particular precisely one first conversion temperature, in particular from at least one martensitic phase into at least one austenitic phase. The shape-shiftable material particularly preferably comprises at least one, in particular precisely one second conversion temperature, in particular from at least one ferromagnetic phase into at least one paramagnetic phase. The first conversion temperature and the second conversion temperature are advantageously selected in such a way that they are at least higher than temperatures which the trigger element assumes in a normal operation state, in particular if a trigger situation is not present. A "thermally and/or magnetically shape-shiftable material" is to be understood in particular as a material which can be influenced by means of a temperature increase, in particular a supply of thermal energy, and/or by means of a magnetic field, in particular an external magnetic field, and is advantageously configured in at least one operation state to change at least one material property and/or one shape at least in dependence on a temperature of the material and/or at least in dependence on the magnetic field. A first object "influencing" a second object is to be understood in this context in particular to mean that the second object has and/or assumes a different state, a different shape, and/or a different location in the case of an absence and/or inactivity of the first object than in the case of a presence and/or activity of the first object. "At least substantially" is to be understood in this context in particular to mean that a deviation from a predetermined value in particular corresponds to less than 15%, preferably less than 10%, and particularly preferably less than 5% of the predetermined value.

In a further embodiment of the invention, it is proposed that the trigger element comprises at least one magnetic high-temperature shape-memory alloy. In particular, the shape-shiftable material is formed as the magnetic high-temperature shape-memory alloy. The magnetic high-temperature shape-memory alloy is preferably distinguished in that the first conversion temperature and/or the second conversion temperature is/are at least 60° C., advantageously at least 70° C., particularly advantageously at least 80° C., and preferably at least 100° C. Incorrect triggering, for example, because of an elevated ambient temperature, can advantageously be prevented in this way. Furthermore, a high achievable length change of a trigger element can advantageously be enabled.

The shape-shiftable material preferably contains nickel, manganese, and gallium. The shape-shiftable material is particularly preferably a nickel-manganese-gallium alloy. In this way, in particular a particularly simply achievable deformability having an advantageously large movement distance can be implemented.

Alternatively, the shape-shiftable material could also be an iron-palladium alloy and/or an iron-palladium-containing alloy. Moreover, the shape-shiftable material could also be formed as a foam and/or as a composite structure and/or as a granulate and/or as a porous material, wherein it is conceivable in particular in the case of a composite material that nickel, manganese, and/or gallium components can be embedded in a matrix.

Furthermore, it is proposed that the shape-shiftable material is of monocrystalline design. The trigger element is preferably formed as a monocrystal from the shape-shiftable material. It is also conceivable that the trigger element is assembled from multiple, in particular from several, for example from two or three or four or five individual monocrystals. In this way, in particular an advantageously large lifting action can be achieved. However, it is also conceivable that the shape-shiftable material is of polycrystalline design.

Furthermore, it is proposed that the trigger element, in particular in the thermal trigger situation, is configured for a generation of an actuation movement that is sufficient for an actuation of the interrupter switch as a result of at least one thermally-induced shape shift and, in particular in the magnetic trigger situation, is configured for an actuation force that is sufficient for an actuation of the interrupter switch as a result of at least one magnetically-induced shape shift. In particular, an actuation force generated during the thermally-induced shape shift, in particular in the thermal trigger situation, is greater than an actuation force generated during the magnetically-induced shape shift, in particular in the magnetic trigger situation. Furthermore, in particular an actuation movement, in particular a generated lift, generated during the magnetically-induced shape shift, in particular in the magnetic trigger situation, is more extensive and/or greater than an actuation movement, in particular a generated lift, generated during the thermally-induced shape shift, in particular in the thermal trigger situation. An actuation force generated in the magnetic trigger situation and an actuation movement generated in the thermal trigger situation, in particular a generated lift, is preferably sufficient for an actuation of the interrupter switch. A high degree of reliability can advantageously be achieved in this way. Furthermore, in this way a protective function can be exerted by a single trigger element both in a short-circuit situation and also in an overload situation.

Furthermore, it is proposed that the thermally-induced shape shift, in particular in the trigger situation, advantageously in the magnetic trigger situation and in the thermal trigger situation, includes a length change of the trigger element, in particular along its longitudinal axis, of at least 1.5%, preferably of at least 2%, and particularly preferably of at least 4%. A reliable actuation of a trigger mechanism can advantageously be achieved in this way.

Moreover, it is proposed that the magnetically-induced shape shift includes a force generation, in particular of the actuation force, advantageously in a direction in parallel to the longitudinal axis of the trigger element, of at least 1 N, preferably of at least 1.5 N, more preferably of at least 2 N per 1 $mm^2$ of cross-sectional area of the trigger element, in particular of a cross section perpendicular to the longitudinal axis of the trigger element, in particular perpendicular to the longitudinal axis of the trigger element. Reliable triggering of a trigger mechanism can advantageously be enabled in this way.

In a further embodiment of the invention, it is proposed that the overcurrent protection device comprises a reset unit, which is mechanical in particular, having at least one reset element, which is mechanical in particular, and which is configured for a re-deformation, which is in particular mechanically induced, of the trigger element after an occurrence of the trigger situation. The reset unit is preferably configured to reestablish a starting shape of the trigger element. The trigger element is particularly preferably configured for a repeated non-damaging deformation in trigger situations and a re-deformation by the reset unit. In particular, the reset element is configured to exert a reset force on the trigger element, which is applied in particular in parallel to the longitudinal axis of the trigger element and/or which is configured for an elongation or a compression of the trigger element, in particular along its longitudinal axis. In particular, the reset element comprises at least one compression spring and/or at least one traction spring and is in particular formed as such. In particular in the case of a compression spring, it is conceivable that the reset element is configured for a re-deformation of the trigger element by means of compression or by means of stretching, wherein the reset unit possibly comprises a corresponding bearing unit for the reset element. A re-deformation of the trigger element by means of elongation or by means of stretching is also conceivable in particular in the case of a traction spring. A repeatedly usable overcurrent protection device can be provided in this way. Furthermore, a structural simplicity can be achieved in this way.

In one advantageous embodiment of the invention, it is proposed that the reset element, observed from the trigger element, is arranged in front of and/or beside the actuation element. In particular, a point of the actuation element most remote from the trigger element is more remote from the trigger element than a point of the reset element most remote from the trigger element, in particular measured along the longitudinal axis of the trigger element. It is conceivable that the actuation element is configured to transmit the reset force during the re-deformation of the trigger element from the reset element to the trigger element. The actuation element preferably comprises at least one force transmission element, which is configured for a transmission of a reset force from the reset element to the actuation element. A compact construction can advantageously be achieved in this way.

In a particularly advantageous embodiment of the invention, it is proposed that the reset element at least partially encompasses the trigger element. In particular in the case in which the reset element is formed as a spring, the trigger element advantageously passes through an interior of the reset element. The trigger unit and/or the reset unit preferably comprises at least one bearing element, preferably two bearing elements arranged opposing, in particular along the longitudinal axis of the trigger element, wherein the reset element is particularly advantageously connected to at least one of the bearing elements and/or is configured for transmitting the reset force to at least one of the bearing elements. In particular in this case, it is conceivable that the trigger unit and the reset unit are at least partially integrally connected to one another and/or comprise at least one common element, in particular a bearing element. Alternatively or additionally, it is conceivable that the reset element at least partially encompasses the actuation element or vice versa. In particular, the actuation element extends at least in sections through the reset element or vice versa. The reset element is preferably formed as a coiled spring, which encompasses at least one section, which is cylindrical and/or hollow-cylindrical and/or pin-shaped in particular, of the actuation element. A first object and a second object being connected "at least partially integrally" to one another is to be understood in this context in particular to mean that at least one element and/or part of the first object is integrally connected to at least one element and/or part of the second object. A direct force introduction and/or a compact construction can advantageously be achieved in this way.

In a further embodiment of the invention, it is proposed that the overcurrent protection device comprises a housing unit, which at least partially houses the trigger element and the reset element. The housing unit advantageously defines at least one accommodation space for the trigger element. The trigger element and the reset element and also advantageously the bearing elements are particularly advantageously arranged inside the accommodation space. The housing unit preferably comprises at least one accommodation region for the conductor section. The conductor section is preferably arranged outside the accommodation space. The housing unit particularly preferably forms a coil body, in particular if the conductor section comprises at least one coil. The housing unit is advantageously at least partially and in particular at least in a majority formed from a non-ferromagnetic material, for example from a non-magnetic iron or steel, another suitable metal, a plastic, a ceramic, or another suitable material. It is also conceivable that the housing unit is formed at least partially and in particular at least in a majority from a ferromagnetic, advantageously a soft magnetic material, for example, iron. In particular in this case, the housing unit can form a magnetic flux conduction unit and/or at least one magnetic flux conduction element. A durable and compact overcurrent protection device can advantageously be provided in this way.

Furthermore, it is proposed that the overcurrent protection device comprises a transmission unit, which comprises at least one transmission element, which is configured for a transmission of an actuation force and/or actuation movement generated in the triggering case by the triggering element, in particular in a transmission ratio different from 1. It is also conceivable that the transmission unit is configured for a deflection of the actuation force and/or the actuation movement. In particular, it is conceivable that the transmission unit is solely configured for a deflection while a transmission ratio is 1. The transmission element is advantageously formed as a lever element. The transmission unit can be configured for an increase of a force, an increase of a lift, and/or a deflection. In particular, the transmission unit is configured to transmit an in particular converted actuation movement and/or actuation force from the actuation element to the interrupter switch. The actuation element preferably bears at least in the trigger situation on the transmission element. A high degree of flexibility with respect to an adaptation and/or design of a trigger unit, in particular with regard to a trigger movement and/or trigger force to be achieved, can advantageously be achieved in this way.

Furthermore, it is proposed that the trigger unit comprises at least one fixed support for the trigger element, which is arranged behind the trigger element, in particular observed from the actuation element. The bearing element preferably forms the fixed support. It is conceivable that the trigger element is fixedly mounted on at least one of its front faces. Furthermore, it is conceivable that the trigger element is mounted in a floating manner, in particular on an opposing front face. However, it is also conceivable that the trigger element is fixedly mounted on at least two opposing sides, in particular on front faces. The trigger element is preferably permanently connected to the bearing element. The bearing element is particularly preferably formed as non-magnetic and/or non-magnetizable. A high degree of robustness, in particular of a bearing unit of a shape-changing element, can advantageously be achieved in this way.

Moreover, it is proposed that the conductor section encompasses the trigger element at least section-wise. The conductor section advantageously describes at most ten revolutions, particularly advantageously at most three, and preferably at most one revolution around the trigger element, wherein in particular low loss currents can advantageously be achieved for a reduced number of revolutions. In particular, the conductor section comprises at least one, in particular precisely one coil, which extends around the trigger element, in particular around its longitudinal axis, and also in particular around the housing unit. A longitudinal axis of the coil and the longitudinal axis of the trigger element are preferably arranged at least substantially in parallel to one another. In particular in this case, the conductor section is advantageously configured for a generation of a magnetic field, the field lines of which extend at least section-wise at least substantially in parallel to the longitudinal axis of the trigger element, in particular inside the trigger element, in the trigger situation, in particular in the magnetic trigger situation. In this way, a low trigger time can advantageously be achieved, in particular as a result of an enabled small spacing between a coil and a trigger element and/or because of a possible omission of ferromagnetic components in the magnetic circuit with nonetheless sufficiently large magnetic flux density.

A high degree of compactness and/or flexibility with respect to a design of a response behavior in an overload situation can be achieved in particular if the trigger unit comprises at least one magnetic flux conduction unit, in particular a ferromagnetic and/or soft-magnetic core. The ferromagnetic core preferably comprises at least one accommodation region for the conductor section. In particular, the ferromagnetic core is formed as a magnetic flux conduction element. It is conceivable that the ferromagnetic core is at least partially integrally connected to the housing unit. In particular, the ferromagnetic core at least partially encompasses the trigger element. The ferromagnetic core is preferably configured for a conduction of a magnetic field generated by the conductor section through the trigger element at least section-wise at least substantially perpendicularly to the longitudinal axis of the trigger element. In particular, a degree and a chronological behavior of heating of a trigger element in an overload situation can be intentionally set in this way. Furthermore, a trigger magnetic field can be intentionally controlled in this way.

However, it is also conceivable that the overcurrent protection device is free of an iron core and/or a magnetic flux conduction element, in particular in the case in which the conductor section at least partially encompasses the trigger element and/or extends around it as a coil. In particular, the conductor section can be formed as an air coil. In this way, a response behavior, in particular in the thermal trigger situation, can advantageously be adapted in an application-specific manner. For example, in this way additional heating as a result of losses in an iron core can be avoided.

In one advantageous embodiment of the invention, it is proposed that in the trigger situation the trigger element is configured for a generation of the actuation force and/or the actuation movement as a result of a shortening of the trigger element, in particular along its longitudinal axis. In particular in this case, the reset unit is advantageously configured for an elongation of the trigger element for its re-deformation. It is conceivable that the actuation element is configured in particular in this case for a transmission of a traction force. It is also conceivable that the interrupter switch and/or the transmission element in particular in this case apply to the actuation element and/or the trigger element a pressure force, which the trigger element yields to in the trigger situation and/or which permits in the trigger situation an actuation of the transmission element as a result of a yielding movement and/or a retraction of the trigger element. The conductor section is preferably configured in particular in this case, in particular in the trigger situation, for a generation of a magnetic field, the field lines of which extend inside the trigger element at least section-wise at least substantially in parallel to its longitudinal axis. A low switching time can advantageously be achieved in this way. Furthermore, in this way a trigger coil can be arranged efficiently with respect to installation space and/or favorably with respect to a spacing between the trigger coil and a trigger element in such a way that it encompasses the trigger element.

Furthermore, it is proposed that the trigger unit is designed in such a way that a deformation is sufficient for the actuation which includes a shortening of the trigger element by at most 5%, preferably by at most 4%, and particularly preferably by at most 2%, in particular along its longitudinal axis. In particular, it is conceivable that the shape-shiftable material is configured for a generation of a thermally triggered compression from an elongated state, preferably caused by a phase transition from a martensitic phase into an austenitic phase. In this way, an overcurrent protection switch having a shortening and rapidly responding trigger element can advantageously be provided.

However, it is also conceivable in principle that, in the trigger situation, the trigger element is configured for a generation of the actuation force and/or the actuation movement as a result of an expansion of the trigger element, in particular along its longitudinal axis. In particular in this case, the conductor section is advantageously configured for a generation of a magnetic field, the field lines of which extend through the trigger element at least substantially perpendicularly to the longitudinal axis of the trigger element, in particular in the trigger situation.

A high degree of reliability and/or advantageous properties with respect to a design can be achieved in particular using an overcurrent protection switch having at least one overcurrent protection device according to the invention.

Furthermore, the invention comprises a system having at least one first overcurrent protection device according to the invention and having at least one second overcurrent protection device according to the invention, wherein the first overcurrent protection device and the second overcurrent protection device are of the same type, in particular are of a fundamentally identical construction and/or are configured for an identical or similar intended use, and wherein for a given trigger situation, the first overcurrent protection device displays a different magnetic and/or thermal triggering behavior than the second overcurrent protection device. The first overcurrent protection device and the second overcurrent protection device are preferably configured for installation in an identical and/or similar manner, for example, in each case as an automatic circuit breaker in a fuse box. In particular, the first overcurrent protection device and the second overcurrent protection device are installable in an equivalent manner in a specific overcurrent protection switch. In particular, the first overcurrent protection device and the second overcurrent protection device can comprise trigger elements which differ with respect to a material and/or a geometry, such as for example a length and/or a shaping. Furthermore, it is conceivable that a trigger unit of the first overcurrent protection device and a trigger unit of the second overcurrent protection device differ with respect to a presence or an embodiment of a magnetic flux conduction unit, in particular a ferromagnetic core, a spacing between a conductor section conducting a current to be monitored and a trigger element, a geometry of such conductor sections, or the like. In particular, it is conceivable that the first overcurrent protection device and the second overcurrent protection device, for the given trigger situation, display an identical magnetic triggering behavior, in particular in a short-circuit situation, and different thermal triggering behavior, in particular in an overload situation, or vice versa. Furthermore, it is conceivable that the system comprises a plurality of overcurrent protection devices, which, in particular with respect to at least one trigger property, such as for example an overcurrent triggering behavior, display a response behavior which is staggered and/or sortable according to at least one parameter, for example triggering in the event of increasing overload current or also triggering in the event of increasing short-circuit current or the like.

The overcurrent protection device according to the invention is not to be restricted in this case to the above-described application and embodiment. In particular, the overcurrent protection device according to the invention, to fulfill a functionality described herein, can have a number of individual elements, components and units deviating from a number mentioned herein.

DRAWINGS

Further advantages result from the following description of the drawings. Three exemplary embodiments of the invention are illustrated in the drawings. The drawings, the description, and the claims contain numerous features in combination. A person skilled in the art will expediently also consider the features individually and combine them to form further reasonable combinations.

Figure 2:
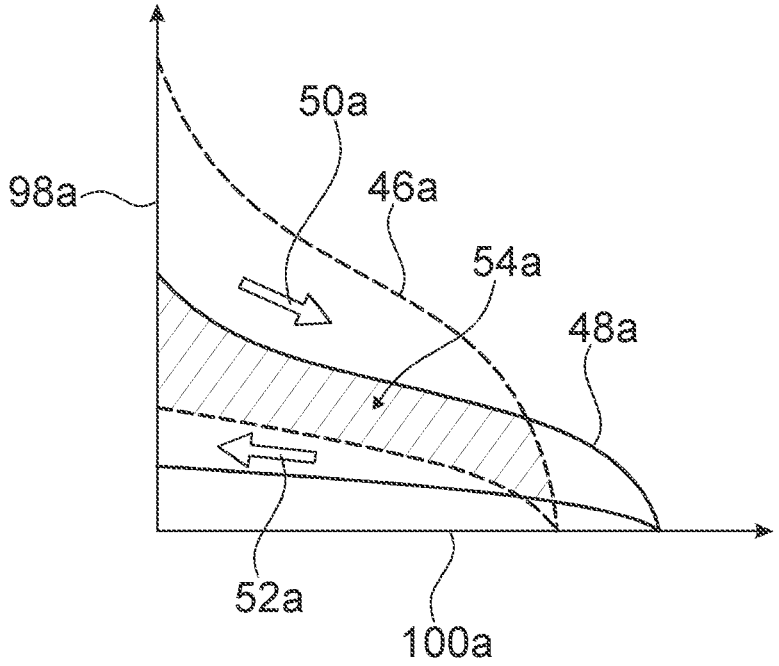
Figure 3:
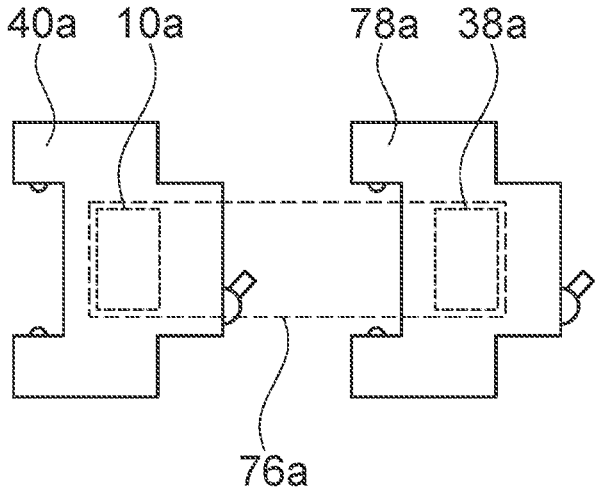
Figure 4:
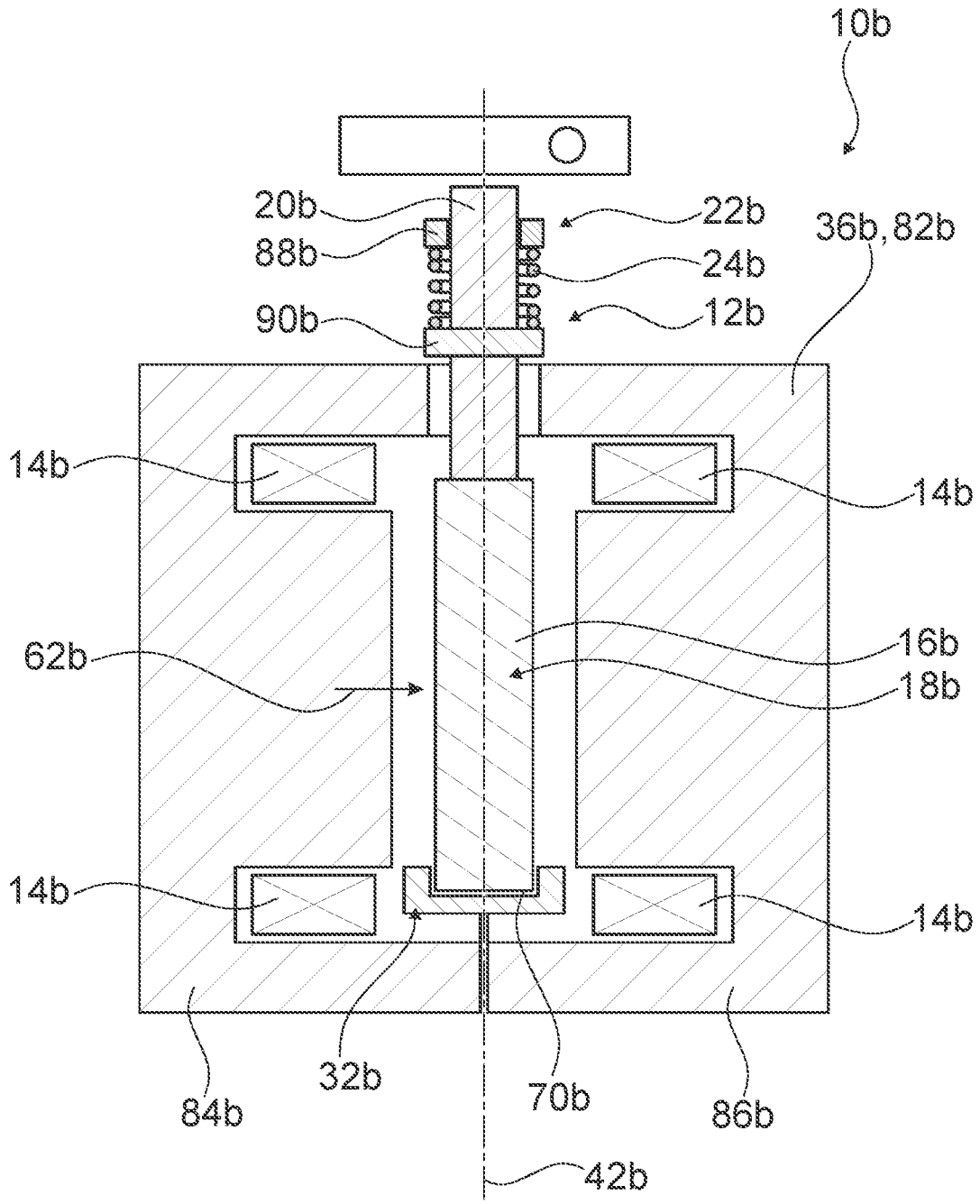
Figure 5:
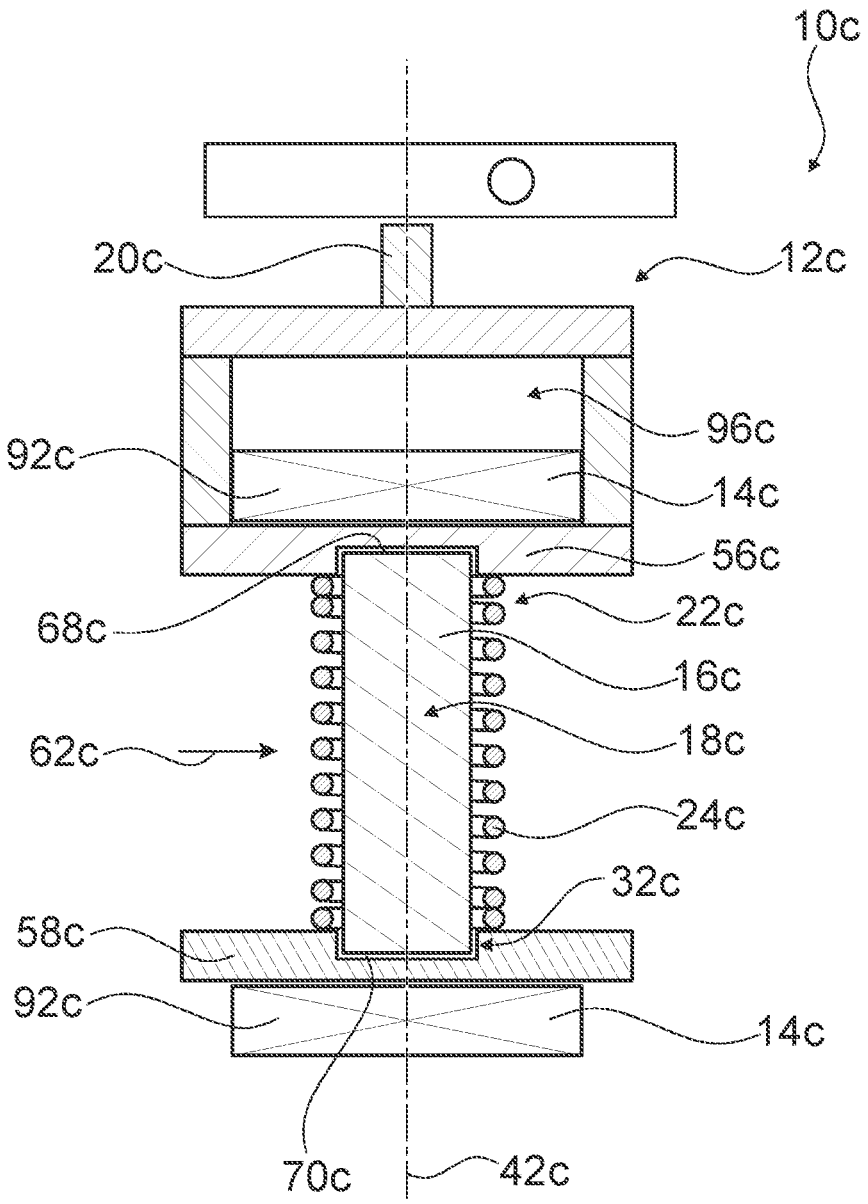

In the figures:

FIG. 1 shows an overcurrent protection device in a schematic sectional illustration, FIG. 2 shows a schematic stress-strain diagram of a shape-shiftable material of the overcurrent protection device, FIG. 3 shows a system having the overcurrent protection device and having a second overcurrent protection device in a schematic illustration, FIG. 4 shows an alternative overcurrent protection device in a schematic sectional illustration, and FIG. 5 shows a further alternative overcurrent protection device in a schematic sectional illustration.

DESCRIPTION OF THE EXEMPLARY EMBODIMENTS

FIG. 1 shows an overcurrent protection device 10*a* for a circuit to be monitored in a schematic sectional illustration. The overcurrent protection device 10*a* is part of an overcurrent protection switch 40*a* (cf. FIG. 3). The overcurrent protection device 10*a* is designed in the present case as an automatic circuit breaker device. The overcurrent protection switch 40*a* is designed in the present case as an automatic circuit breaker.

The overcurrent protection device 10*a* comprises a trigger unit 12*a*, which is configured for interrupting the circuit in at least one trigger situation. The trigger situation can comprise a short-circuit situation and/or an overload situation. In particular, the trigger situation comprises a thermal trigger situation, for example the overload situation, and/or a magnetic trigger situation, for example the short-circuit situation. The trigger unit 12*a* comprises at least one conductor section 14*a*, which is configured for a conduction of a current to be monitored. In the present case, the current to be monitored flows in the circuit. Furthermore, the trigger unit 12*a* comprises at least one trigger element 16*a*, which comprises at least one magnetically and thermally shape-shiftable material 18*a*. The trigger element 16*a* is in the trigger situation configured for a thermally-induced and/or magnetically-induced deformation in dependence on a current that flows through the conductor section 14*a*, in particular in dependence on the current to be monitored. Furthermore, the trigger unit 12*a* comprises at least one actuation element 20*a*, which is operatively connected with the trigger element 16*a*, and which is configured for transmitting at least one actuation movement and/or at least one actuation force to at least one interrupter switch (not shown). In the present case, the interrupter switch is a part of the overcurrent protection switch 40*a*. However, it is also conceivable that the interrupter switch is part of the overcurrent protection device 10*a*.

The shape-shiftable material 18*a* is a thermal and magnetic shape-memory material. The trigger element 16*a* is formed as thermally and magnetically shape-changing. The trigger element 16*a* is formed in the present case from the shape-shiftable material 18*a*. The shape-shiftable material 18*a* is monocrystalline, wherein a polycrystalline material is also conceivable. The trigger element 16*a* is formed as a one-piece monocrystal made of the shape-shiftable material 18*a* in the present case, wherein multipart trigger elements are also conceivable. In the present case, the trigger element 16*a* can be influenced and in particular deformed by means of a magnetic field and/or a mechanical force and/or a change of a temperature of the trigger element 16*a*.

In addition, the shape-shiftable material 18*a* has the property that as a reaction to a mechanical force having a defined minimal strength and a defined direction, a deformation and/or shape shift, which is mechanical in particular, takes place. For a deformation and/or shape shift of the trigger element 16*a*, in this case an inner force of the trigger element 16*a*, caused in the present case in particular by a magnetomechanical hysteresis of the shape-shiftable material 18*a* used, has to be overcome. A movement back into a base shape and/or starting shape also does not automatically occur in this case after a reduction and/or an interruption of the mechanical force and/or a mechanical strain. The trigger element 16*a* would thus also remain in the present shape in this case, in particular without an external reset stimulus, after the reduction and/or the interruption of the mechanical force and/or the mechanical strain.

FIG. 2 shows a schematic stress-strain diagram of the shape-shiftable material 18*a*. The stress-strain diagram comprises a tension axis 98*a* and an expansion axis 100*a*. The characteristic curves shown and in particular the axial sections thereof are to be understood solely as examples. The shape-shiftable material 18*a* displays a hysteresis characteristic curve 46*a*, which characterizes a thermal shape-memory effect of the shape-shiftable material 18*a*. Furthermore, the shape-shiftable material 18*a* displays a further hysteresis characteristic curve 48*a*, which characterizes a magnetic shape-memory effect of the shape-shiftable material 18*a*. In the diagram, the cases of an elongation (characterized by a direction arrow 50*a*) and a compression (characterized by a direction arrow 52*a*) are shown. A greater extension change, in particular a greater lift, can be achieved by means of utilization of the magnetic shape-memory effect, while a greater actuation force can be generated by means of utilization of the thermal shape-memory effect. The two characteristic curves 46*a*, 48*a* thus define a usable operation range 54*a*, which is shown shaded in the diagram. Depending on the embodiment of the thermal and the magnetic shape-memory effect and/or depending on the selection of a shape-shiftable material, the resulting usable operation range can be larger or smaller. In the present case, the shape-shiftable material 18*a* has a composition such that an elongation of approximately 4% can be generated by means of the thermal shape-memory effect. However, alloys are also conceivable in which a corresponding elongation of 5% or 6% is achievable. Furthermore, the shape-shiftable material 18*a* has a composition in the present case such that by means of the thermal shape-memory effect, a compression can be generated, proceeding from an elongated state, of approximately 2%. In this case, however, alloys are also conceivable in which a corresponding compression of 3% or 4% is achievable. Furthermore, utilizing the magnetic shape-memory effect for the present shape-shiftable material 18*a*, a magnetically inducible length change, in particular a compression or an elongation, of approximately 6% is achievable, wherein values of 8% up to 10% or 12% are also conceivable.

As FIG. 1 shows, the trigger element 16*a* is formed pin-shaped in the present case, in particular having a rectangular cross-sectional area perpendicular to the longitudinal axis 42*a*. The trigger element 16*a* comprises a longitudinal axis 42*a*, which is arranged in parallel to a main extension direction 44*a* of the trigger element 16*a*. The trigger element 16*a* is configured for a length change along its longitudinal axis 42*a* in the trigger situation. In the present case, the trigger element 16*a* is in the trigger situation configured for a generation of the actuation force and/or the actuation movement because of a shortening of the trigger element 16*a*. The shortening is furthermore in the present case a shortening along the longitudinal axis 42*a* of the trigger element 16*a*.

In the present case, the trigger element 16*a* is configured for a generation of an actuation movement that is sufficient for an actuation of the interrupter switch as a result of at least one thermally-induced shape shift and is configured for an actuation force that is sufficient for an actuation of the interrupter switch as a result of at least one magnetically induced shape shift. In particular in the thermal trigger situation, an extension change, in particular the shortening, of the trigger element 16*a* is sufficient to generate the actuation movement for the interrupter switch. Furthermore, in the magnetic trigger situation, a force generated by the trigger element 16*a*, in particular acting in parallel to the longitudinal axis 42*a* of the trigger element 16*a*, in particular the actuation force, is sufficient for an actuation of the interrupter switch.

The thermally-induced shape shift includes, as mentioned, in the present case a length change of the trigger element 16*a*, in particular along its longitudinal axis 42*a*, of at least 1.5%, in particular of approximately 2%, wherein greater values are also conceivable. The length change is furthermore in the present case the shortening of the trigger element 16*a*. The trigger unit 12*a* is designed in such a way that a deformation is sufficient for the actuation of the interrupter switch which includes a shortening of the trigger element 16*a* by at most 5%, in the present case even by at most 2%. A thermally-induced shortening of the trigger element 16*a*, in particular in the overload situation, is therefore sufficient for an actuation of the interrupter switch.

The magnetically-induced shape shift includes a force generation of at least 1 N per 1 $mm^2$ of cross-sectional area of the trigger element 16*a*, in particular perpendicularly to the longitudinal axis 42*a* of the trigger element 16*a*. In the present case, the force generation is even at least 2 N per 1 $mm^2$ of cross-sectional area of the trigger element 16*a*.

The shape-shiftable material 18*a* is a magnetic shape-memory alloy, wherein, as mentioned above, other materials are also fundamentally conceivable. In the present case, the shape-shiftable material 18*a* is a shape-memory alloy, which contains nickel, manganese, and gallium. Furthermore, the trigger element 16*a* comprises at least one magnetic high-temperature shape-memory alloy in the present case. In particular, the shape-shiftable material 18*a* is formed as the magnetic high-temperature shape-memory alloy. The magnetic high-temperature shape-memory alloy has in the present case a first conversion temperature from a martensitic phase into an austenitic phase and a second conversion temperature from a ferromagnetic phase into a paramagnetic phase, wherein the first and the second conversion temperatures are at least 60° C., in the present case at least 70° C., wherein higher values of at least 80° C. or 100° C. are also advantageously conceivable.

The overcurrent protection device 10*a* comprises a transmission unit 28*a*, which comprises at least one transmission element 30*a*, which is configured for a transmission of the actuation force and/or actuation movement generated in the trigger situation by the trigger element 16*a*. In the present case, the transmission element 30*a* is formed as a lever element, in particular as a double-arm lever. The actuation element 20*a*, observed from the trigger element 16*a*, is arranged in front of the transmission element 30*a*. In the trigger situation, the trigger element 16*a* contracts, whereby the actuation element 20*a* is deflected, in particular along the longitudinal axis 42 of the trigger element 16*a*. The transmission element 30*a* is pivoted at the same time. It is conceivable that the transmission element 30*a* is connected directly to the actuation element 20*a*, wherein a connection can be provided in particular for a transmission of a traction force and/or a pulling movement. However, it is also conceivable that the transmission element 30*a* applies a pressure force to the actuation element 20*a* and a movement of the actuation element 20*a* along the longitudinal axis 42*a* of the trigger element 16*a* releases a movement of the transmission element 30*a* in the trigger situation. The transmission unit 28*a* is configured to transmit a transmitted actuation movement and a transmitted actuation force to the interrupter switch. It is also conceivable in this case that the transmission element 30*a* transmits a traction force. It is also conceivable that the transmission element 30*a* transmits a pressure force.

The trigger unit 12*a* comprises at least one fixed support 32*a*, 34*a* for the trigger element 16*a*. In the present case, the trigger unit 12*a* comprises two bearing elements 56*a*, 58*a*, which form the fixed supports 32*a*, 34*a*. A first fixed support 32*a* is arranged in front of the trigger element 16*a* from the actuation element 20*a*. A second fixed support 34*a* is arranged behind the trigger element 16*a* from the actuation element 20*a*. In the trigger situation, the bearing elements 56*a*, 58*a* move toward one another. The fixed supports 32*a*, 34*a* support the trigger element 16*a* on its front faces 68*a*, 70*a*. The bearing elements 56*a*, 58*a* are arranged opposing along the longitudinal axis 42*a* of the trigger element 16*a*, in particular on its front faces 68*a*, 70*a*. The trigger element 16*a* is connected to the bearing elements 56*a*, 58*a*. The trigger element 16*a* can be, for example, adhesively bonded and/or welded onto at least one bearing element 56*a*, 58*a* and/or connected thereto in a friction-locked and/or form-fitting and/or integrally-joined manner in another way. In the present case, the bearing elements 56*a*, 58*a* are formed from non-magnetic iron or another suitable metal, wherein in principle bearing elements made of plastic or ceramic or the like are also conceivable.

The conductor section 14*a* is configured for a generation of a trigger magnetic field, the field lines of which extend in a region of the trigger element 16*a*, in particular in a near region of the trigger element 16*a* and/or inside the trigger element 16*a*, at least substantially in parallel to its longitudinal axis 42*a*, in the trigger situation, in particular in the short-circuit situation. A direction 62*a* of the trigger magnetic field in a near region of the trigger element 16*a* is schematically shown in FIG. 1.

The conductor section 14*a* encompasses the trigger element 16*a* at least section-wise. In the present case, the conductor section 14*a* comprises a coil 60*a*, within which the trigger element 16*a* is arranged. The coil 60*a* extends multiple times around the trigger element 16*a*. A longitudinal axis 64*a* of the coil 60*a* is arranged at least substantially in parallel to the longitudinal axis 42*a* of the trigger element 16*a*. The coil 60*a* is configured for a generation of the trigger magnetic field. In particular, the longitudinal axes 42*a*, 64*a* of the coil 60*a* and the trigger element 16*a* are identical. In the present case, the coil 60*a* is formed as an air coil. In particular, the trigger unit 12*a* is free of an iron core or another magnetic flux conduction element in the present case.

The overcurrent protection device 10*a* comprises a reset unit 22*a* having at least one reset element 24*a*, which is configured for a re-deformation of the trigger element 16*a* after an occurrence of the trigger situation. The reset element 24*a* is formed in the present case as a compression spring. The reset element 24*a* is arranged between the bearing elements 56*a*, 58*a*. The bearing elements 56*a*, 58*a* are part of the reset unit 22*a* in the present case. During the re-deformation, the reset element 24*a* presses the bearing elements 56*a*, 58*a* apart from one another along the longitudinal axis 42*a* of the trigger element 16*a* and generates in particular a reset force for the re-deformation of the trigger element 16*a*. The reset element 24*a* is configured for exerting an elongation force on the trigger element 16*b* for the re-deformation. During the re-deformation, the trigger element 16*a* is elongated and in particular transferred into an elongated starting state.

The reset element 24*a* at least partially encompasses the trigger element 16*a*. In the present case, the reset element 24*a* defines an inner region, within which the trigger element 16*a* is arranged. In particular, a longitudinal axis 66*a* of the reset element 24*a* and the longitudinal axis 42*a* of the trigger element 16*a* are arranged in parallel to one another and in particular are identical. The reset element 24*a* extends in multiple turns around the trigger element 16*a*.

The reset element 24*a*, observed from the actuation element 20*a*, is arranged adjacent to the trigger element 16*a*. The trigger element 16*a* and the reset element 24*a*, observed from the transmission element 30*a*, are arranged behind the actuation element 20*a*. The trigger element 16*a* is arranged at least section-wise inside the reset element 24*a*.

The overcurrent protection device 10*a* comprises a housing unit 26*a*, which at least partially houses at least the trigger element 16*a* and the reset element 24*a*. In the present case, the housing unit 26*a* is formed from a material which is heat resistant and/or has good thermal conductivity, for example from a non-magnetizable metal or a suitable plastic or the like. In particular, the housing unit 26*a* is configured for a heat transfer from the conductor section 14*a* to the trigger element 16*a*, in particular in the thermal trigger situation. It is also fundamentally conceivable that a housing unit is formed at least partially from a magnetic and/or magnetizable material and forms, for example, at least one magnetic flux conduction element, such as an iron core in particular.

In the present case, the housing unit 26*a* defines an accommodation space 72*a* for the trigger element 16*a*. The trigger element 16*a*, the fixed supports 32*a*, 34*a* and the reset element 24*a* are arranged inside the accommodation space 72*a*. Moreover, the actuation element 20*a* is partially arranged inside the accommodation space 72*a*. In the trigger situation, an outer surface of the accommodation space 72*a* forms a slide bearing for the bearing element 56*a*, which moves along the longitudinal axis 42*a* of the trigger element 16*a* toward the stationary bearing element 58*a*. In particular, the bearing element 58*a* is fixed in place in relation to the housing unit 26*a*. The housing unit 26*a* forms a feedthrough 80*a* for the actuation element 20*a*, which can in particular at least partially guide the actuation element 20*a*. In the trigger situation, because of the shortening of the trigger element 16*a*, the actuation element 20*a* is drawn and/or pressed through the feedthrough 80*a* at least farther than in a starting state into the accommodation space 72*a*. Furthermore, in the present case, the housing unit 26*a* defines an accommodation region 74*a* for the conductor section 14*a*. The coil 60*a* is arranged inside the accommodation region 74*a*. The coil 60*a* extends around the accommodation space 72*a*. The housing unit 26*a* forms a coil body for the coil 60*a*.

FIG. 3 shows a system 76*a* having the overcurrent protection device 10*a* and having a second overcurrent protection device 38*a* in a schematic illustration. The overcurrent protection device 10*a* is, as mentioned, part of an overcurrent protection switch 40*a*. The second overcurrent protection device 38*a* is part of a second overcurrent protection switch 78*a*. The overcurrent protection device 10*a* and the second overcurrent protection device 38*a* are of the same type. For example, the second overcurrent protection device 38*a* could be installed instead of the overcurrent protection device 10*a* in the overcurrent protection switch 40*a*. In the present case, the overcurrent protection switch 40*a* and the second overcurrent protection switch 78*a* are at least externally structurally equivalent and/or usable alternatively in relation to one another, for example in corresponding fuse slots of a fuse box.

For a given trigger situation, for example for a specific overcurrent and/or short-circuit current, which is applied over a specific time frame, the overcurrent protection device 10*a* displays a different magnetic and/or thermal triggering behavior than the second overcurrent protection device 38*a*. For example, the second overcurrent protection device 38*a* can differ from the overcurrent protection device 10*a* with respect to a number of coil turns of a conductor section, a geometry of a trigger element, a material of a trigger element, a geometry and/or a material of a housing unit, a presence of an iron core, and the like. For example, by way of a use of components having a high heat capacity, a thermal triggering can be delayed or suppressed. Furthermore, for example, by way of an attenuation of a generated magnetic field, for example by a reduction of a number of windings of a coil, a limiting current required for triggering can be set. Furthermore, it is conceivable that a triggering behavior is adaptable by means of suitable adaptation of a geometry of a transmission unit.

Two further exemplary embodiments of the invention are shown in FIGS. 4 and 5. The following descriptions and the drawings are substantially restricted to the differences between the exemplary embodiments, wherein with regard to identically denoted components, in particular with respect to components having identical reference signs, reference can also be made in principle to the drawings and/or the description of the other exemplary embodiments, in particular to FIGS. 1 to 3. To differentiate the exemplary embodiments, the letter a follows the reference signs of the exemplary embodiment in FIGS. 1 to 3. In the exemplary embodiments of FIGS. 4 and 5, the letter a is replaced by the letters b and c.

FIG. 4 shows an alternative overcurrent protection device 10*b* for a circuit to be monitored in a schematic sectional illustration. The alternative overcurrent protection device 10*b* is part of an overcurrent protection switch (not shown), for example a fuse, in particular an automatic circuit breaker.

The alternative overcurrent protection device 10*b* comprises a trigger unit 12*b*, which is configured for interrupting the circuit in at least one trigger situation. The trigger situation can comprise a short-circuit situation and/or an overload situation. In particular, the trigger situation comprises a thermal trigger situation, for example the overload situation, and/or a magnetic trigger situation, for example the short-circuit situation. The trigger unit 12*b* comprises at least one conductor section 14*b*, which is configured for a conduction of a current to be monitored. In the present case, the current to be monitored flows in the circuit. Furthermore, the trigger unit 12*b* comprises at least one trigger element 16*b*, which comprises at least one magnetically and thermally shape-shiftable material 18*b*. In the present case, the shape-shiftable material 18*b* is a magnetic and thermal shape-memory material. The trigger element 16*b* is in the trigger situation configured for a thermally-induced and/or magnetically-induced deformation in dependence on a current that flows through the conductor section 14*b*, in particular in dependence on the current to be monitored. Furthermore, the trigger unit 12*b* comprises at least one actuation element 20*b*, which is operatively connected with the trigger element 16*b* and is configured for a transmission of at least one actuation movement and/or at least one actuation force to at least one interrupter switch (not shown). In the present case, the interrupter switch is a part of the overcurrent protection switch. However, it is also conceivable that an interrupter switch is part of the alternative overcurrent protection device 10*b*.

The conductor section 14*b* is in the present case configured for a generation of a trigger magnetic field, the field lines of which extend at least in a near region of the trigger element 16*b* and/or inside the trigger element 16*b* at least substantially perpendicularly to a longitudinal axis 42*b* of the trigger element 16*b*, in the trigger situation. A direction 62*b* of the trigger magnetic field in the near region of the trigger element 16*b* is schematically shown in FIG. 4. In the present case, the conductor section 14*b* is formed at least section-wise as a coil. In particular, the conductor section 14*b* forms at least two opposing coils, so that the trigger magnetic field permeates the trigger element 16*b* as homogeneously as possible perpendicularly to the longitudinal axis 42*b*.

The trigger unit 12*b* comprises at least one magnetic flux conduction element 82*b*. In the present case, the trigger unit 12*b* comprises a ferromagnetic core 36*b*, in particular an iron core. The ferromagnetic core 36*b* is configured for an amplification of the trigger magnetic field. In the present case, the ferromagnetic core 36*b* comprises two pole shoes 84*b*, 86*b*, which are in particular arranged opposite. One coil formed by the conductor section 14*b* is associated with each of the pole shoes 84*b*, 86*b*.

In the present case, a shape shift of the trigger element 16*b* in the trigger situation comprises an expansion along its longitudinal axis 42*b*, in particular a thermally-induced and/or magnetically-induced expansion. In this case, in particular in the thermal trigger situation, a comparatively greater lift is advantageously achievable as a result of a thermally-induced expansion than in the case of a thermally-induced compression, in particular similarly to the embodiment shown in FIGS. 1 to 3. In the present case, the trigger element 16*b* is configured in the thermal trigger situation for a length change, in particular an elongation, of approximately 4%. Furthermore, the trigger element 16*b* is configured in the magnetic trigger situation for a length change, in particular an elongation, of approximately 6%. In this case, however, other values are also conceivable depending on the selection of suitable shape-shiftable materials, in particular magnetic and thermal shape-memory alloys. In the present case, a length change of the trigger element 16*b* by approximately 4% is sufficient for an actuation of the interrupter switch.

The trigger unit 12*b* comprises a fixed support 32*b* for the trigger element 16*b*. The fixed support 32*b* supports a front face 70*b* of the trigger element 16*b* facing away from the actuation element 20*b* and is in particular connected thereto in a friction-locked and/or integrally-joined and/or formfitting manner. Upon a generation of the actuation movement and/or the actuation force, the trigger element 16*b* expands, proceeding from the fixed support 32*b*, in the direction of the actuation element 20*b* and pushes it along the longitudinal axis 42*b* of the trigger element 16*b* away from the fixed support 32*b*.

The alternative overcurrent protection device 10*b* comprises a reset unit 22*b* having a reset element 24*b*. The reset element 24*b*, observed from the trigger element 16*b*, is arranged beside the actuation element 20*b*. The actuation element 20*b* passes section-wise through the reset element 24*b*. The reset element 24*b* encompasses the actuation element 20*b* at least section-wise. The reset element 24*b* is formed as a compression spring. The reset unit 22*b* comprises a bearing element 88*b* for the reset element 24*b*. A position of the bearing element 88*b* in relation to the fixed support 32*b* is constant. During the re-deformation, the bearing element 88*b* generates a counter retaining force for the reset element 24*b*. The bearing element 88*b* is formed ring-shaped in the present case. The actuation element 20*b* passes through the bearing element 88*b*. The actuation element 20*b* comprises a counter element 90*b*, against which the reset element 24*b* presses during the re-deformation. The counter element 90*b* is formed collar-shaped in the present case. A reset pressure force of the reset element 24*b* is transmitted during the re-deformation via the actuation element 20*b* onto the trigger element 16*b*.

FIG. 5 shows a further alternative overcurrent protection device 10*c* for a circuit to be monitored in a schematic sectional illustration. The further alternative overcurrent protection device 10*c* is part of an overcurrent protection switch (not shown), for example, a fuse, in particular of an automatic circuit breaker.

The further alternative overcurrent protection device 10*c* comprises a trigger unit 12*c*, which is configured for an interruption of the circuit in at least one trigger situation. The trigger situation can comprise a short-circuit situation and/or an overload situation. In particular, the trigger situation comprises a thermal trigger situation, for example the overload situation, and/or a magnetic trigger situation, for example the short-circuit situation. The trigger unit 12*c* comprises at least one conductor section 14*c*, which is configured for a conduction of a current to be monitored. In the present case, the current to be monitored flows in the circuit. Furthermore, the trigger unit 12*c* comprises at least one trigger element 16*c*, which comprises at least one magnetically and thermally shape-shiftable material 18*c*. The trigger element 16*c* is in the trigger situation configured for a thermally-induced and/or magnetically-induced deformation in dependence on a current that flows through the conductor section 14*c*, in particular in dependence on the current to be monitored. Furthermore, the trigger unit 12*c* comprises at least one actuation element 20*c*, which is operatively connected with the trigger element 16*c*, and which is configured for a transmission of at least one actuation movement and/or at least one actuation force to at least one interrupter switch (not shown). In the present case, the interrupter switch is a part of the overcurrent protection switch. However, it is also conceivable that an interrupter switch is part of the further alternative overcurrent protection device 10*c*.

The conductor section 14*c* is in the present case configured, in the trigger situation, for the generation of a trigger magnetic field, the field lines of which extend at least in a near region of the trigger element 16*c* and/or inside the trigger element 16*c* at least substantially perpendicularly to a longitudinal axis 42*c* of the trigger element 16*c*. A direction 62*c* of the trigger magnetic field in the near region of the trigger element 16*c* is schematically shown in FIG. 5. In the present case, the conductor section 14*c* is formed at least section-wise as a coil. The conductor section 14*c* forms a coil 92*c*. The coil 92*c* encompasses the trigger element 16*c* transversely to its longitudinal axis 42*c*. The coil 92*c* is partially arranged inside the actuation element 20*c*. The actuation element 20*c* forms an accommodation space 96*c*, which partially accommodates the first coil 92*c*. The coil 92*c* is arranged partially in front of the trigger element 16*c* and partially behind the trigger element 16*c* from the actuation element 12*c*. The coil 92*c* is configured for the generation of the trigger magnetic field in such a way that its field lines extend at least substantially in parallel to the direction 62*c* in the trigger situation.

In the present case, the trigger unit 12*c* is free of a magnetic flux conduction element and in particular free of an iron core. The conductor section 14*c* forms at least one air coil in the present case. In particular, the coil 92*c* is formed as an air coil.

The further alternative overcurrent protection device 10*c* comprises a reset unit 22*c* having a reset element 24*c*. The reset element 24*c* is formed as a traction spring. The reset element 24*c* is, observed from the trigger element 16*c*, arranged in front of the actuation element 20*c*. The reset element 24*c* is configured for the generation of a compression force on the trigger element 16*c* for a re-deformation thereof, in particular at least substantially in parallel to the longitudinal axis 42*c* of the trigger element 16*c*.

The reset element 24*c* is connected to bearing elements 56*c*, 58*c* for the trigger element 16*c*. A first bearing element 56*c* is connected to the actuation element 20*c* and/or is formed thereby. A second bearing element 58*c* forms a fixed support 32*c* for the trigger element 16*c*. The second bearing element 58*c* supports a front face 70*c* of the trigger element 16*c* facing away from the actuation element 20*c*. For the re-deformation, the reset element 24*c* pulls the bearing elements 56*c*, 58*c* toward one another, whereby the compression force acting on the trigger element 16*c* is generated.

The invention claimed is:

1. An overcurrent protection device for a circuit to be monitored, comprising:

at least one trigger unit, which is configured for an interruption of the circuit in at least one trigger situation and which comprises at least one conductor section, which is configured for a conduction of a current to be monitored, at least one trigger element, which comprises at least one magnetically and thermally shape-shiftable material and is, in the trigger situation, configured for a thermally-induced and/or magnetically-induced deformation in dependence on a current that flows through the conductor section, and at least one actuation element, which is operatively connected with the trigger element and is configured for a transmission of at least one actuation movement and/or at least one actuation force to at least one interrupter switch, wherein the trigger element comprises at least one magnetic shape-memory alloy, which has a first conversion temperature from a martensitic phase into an austenitic phase and a second conversion temperature from a ferromagnetic phase into a paramagnetic phase, wherein the first and the second conversion temperatures are at least 60° C.

2. The overcurrent protection device as claimed in claim 1, wherein the trigger element is configured for an actuation movement that is sufficient for an actuation of the interrupter switch as a result of at least one thermally-induced shape shift, and is configured for an actuation force that is sufficient for an actuation of the interrupter switch as a result of at least one magnetically-induced shape shift.

3. The overcurrent protection device as claimed in claim 2, wherein the thermally-induced shape shift includes a length change of the trigger element of at least 1.5%.

4. The overcurrent protection device as claimed in claim 2, wherein the magnetically-induced shape shift includes a force generation of at least 1 N per 1 $mm^2$ of cross-sectional area of the trigger element.

5. The overcurrent protection device as claimed in claim 1, comprising a reset unit having at least one reset element, which is configured for a re-deformation of the trigger element after an occurrence of the trigger situation.

6. The overcurrent protection device as claimed in claim 5, wherein the reset element, observed from the trigger element, is arranged in front of and/or beside the actuation element.

7. The overcurrent protection device as claimed in claim 5, wherein the reset element at least partially encompasses the trigger element.

8. The overcurrent protection device as claimed in claim 5, wherein the reset element comprises at least one compression spring and/or at least one traction spring.

9. The overcurrent protection device as claimed in claim 5, comprising a housing unit, which at least partially houses at least the trigger element and the reset element.

10. The overcurrent protection device as claimed in claim 1, wherein, in the trigger situation, the trigger element is configured for a generation of the actuation force and/or of the actuation movement as a result of a shortening of the trigger element.

11. The overcurrent protection device as claimed in claim 10, wherein the trigger unit is designed in such a way that for the actuation, a deformation is sufficient which includes a shortening of the trigger element by 5% or less.

12. The overcurrent protection device as claimed in claim 1, comprising a transmission unit, which comprises at least one transmission element, which is configured for a transmission of an actuation force and/or actuation movement generated by the trigger element in the trigger situation.

13. The overcurrent protection device as claimed in claim 1, wherein the trigger unit comprises at least one fixed support for the trigger element which, observed from the actuation element, is arranged behind the trigger element.

14. The overcurrent protection device as claimed in claim 1, wherein the conductor section encompasses the trigger element at least section-wise.

15. The overcurrent protection device as claimed in claim 1, wherein the trigger unit comprises at least one ferromagnetic core.

16. The overcurrent protection device as claimed in claim 1, wherein the shape-shiftable material is a magnetic shape-memory alloy, in particular a magnetic shape-memory alloy which contains nickel, manganese, and gallium.

17. The overcurrent protection device as claimed in claim 1, wherein the shape-shiftable material is of monocrystalline design.

18. A system having at least one first overcurrent protection device and having at least one second overcurrent protection device, each as claimed in claim 1, wherein the first overcurrent protection device and the second overcurrent protection device are of the same type, and wherein for a given trigger situation, the first overcurrent protection device displays a different magnetic and/or thermal triggering behavior than the second overcurrent protection device.

19. An overcurrent protection switch, in particular a line circuit breaker, having at least one overcurrent protection device as claimed in claim 1.

* * * * *